US011373561B1

(12) United States Patent
Lowe

(10) Patent No.: US 11,373,561 B1
(45) Date of Patent: Jun. 28, 2022

(54) PERIMETER PROTECTIVE DEVICE FOR FLOOR SIGN

(71) Applicant: Clifford A. Lowe, Wake Forest, NC (US)

(72) Inventor: Clifford A. Lowe, Wake Forest, NC (US)

(73) Assignee: Insite Solutions, LLC, Youngsville, NC (US)

( * ) Notice: Subject to any disclaimer, the term of this patent is extended or adjusted under 35 U.S.C. 154(b) by 0 days.

(21) Appl. No.: 17/191,428

(22) Filed: Mar. 3, 2021

Related U.S. Application Data

(60) Provisional application No. 62/984,726, filed on Mar. 3, 2020.

(51) Int. Cl.
*G09F 15/00* (2006.01)
*G09F 19/22* (2006.01)
*G09F 13/04* (2006.01)

(52) U.S. Cl.
CPC ..... *G09F 15/0056* (2013.01); *G09F 19/22* (2013.01); *G09F 19/228* (2013.01); *G09F 13/0495* (2021.05)

(58) Field of Classification Search
CPC ..... G09F 19/228; G09F 2013/0495
USPC ..... 40/565, 217
See application file for complete search history.

(56) References Cited

U.S. PATENT DOCUMENTS 2,231,780 A 2/1941 Swenson
2,586,978 A 2/1952 Murray
2,919,456 A * 1/1960 Spivey ..... A47L 23/266 15/215
7,361,403 B1 4/2008 Lowe
8,088,480 B2 1/2012 Goecke
8,883,290 B2 11/2014 Lowe
10,524,602 B2 * 1/2020 Johnson ..... A47G 27/0231
2002/0108323 A1 * 8/2002 Gruber ..... E04F 15/02 52/177
2004/0021617 A1 * 2/2004 Blum ..... G09F 9/30 345/1.3
2007/0042159 A1 * 2/2007 Sugihara ..... E04F 15/185 428/156

(Continued)

OTHER PUBLICATIONS

U.S. Appl. No. 13/769,092, filed Feb. 15, 2013, Clifford A. Lowe, inventor.

(Continued)

*Primary Examiner* — Gary C Hoge
(74) *Attorney, Agent, or Firm* — Fred Zollinger

(57) ABSTRACT

A protective device is installed about the outer edge or outer edges of a floor sign. When installed, the main body portion of the protective device is taller than the thickness of the sign such that an item being moved over the sign will ride on the top of the protective device as it passes over the floor sign. The protective device includes a tapered outer edge that helps an item to slide up onto the top surface of the protective device and decrease the impact force of the device when it initially encounter the protective device. The inner edge of the protective device is also tapered down to at least the height of the floor sign. The protective device is made from a hard material that is impact resistant and provides a smooth lower friction upper surface. The protective device can be installed with spaced ends to allow liquid to drain from inside the device.

21 Claims, 5 Drawing Sheets

(56) References Cited

U.S. PATENT DOCUMENTS

| | | | | |
|---|---|---|---|---|
| 2011/0296727 | A1* | 12/2011 | Savagian | B32B 27/36 40/594 |
| 2015/0096209 | A1* | 4/2015 | Biehl | B64D 25/00 40/542 |

OTHER PUBLICATIONS

Admitted prior art, metal floor frames for labels, three examples.
ASG Services, LLC, Aluminum Floor Label Frame, printed Mar. 3, 2020 from https://www.asgonlinestore.com/1-16-7-x-5-aluminum-floor-label-frame.html.
Megadepot, Accumform DTF817, printed Mar. 3, 2020 from https://megadepot.com/catalog/safety/sign-posts-accessories/$1176.5-3000.
DASKO Label, Metal Floor Frames, printed Mar. 3, 2020 from https://www.daskolabel.com/floor-labels/duracode-frames/.
Camcode, Screw-Down Warehouse Floor Labels, printed Mar. 3, 2020 from https://www.camcode.com/screw-down-floor-labels.html.
Insite Solutions, LLC, Floor Signs, printed Feb. 25, 2021 from https://stop-painting.com/products/floor-signs/.
Insite Solutions, LLC, Pre-Cut Kits, printed Mar. 25, 2021 from https://stop-painting.com/floor-marking-tapes/pre-cut-kits/.
Insite Solutions, LLC, Beveled Guard—Floor Sign Protector, printed Mar. 25, 2021 from https://stop-painting.com/beveled-guard-floor-sign-protector/.
Stop-Painting.com, Youtube, Beveled Guards—The 3-Step Protection Plan, dated Mar. 17, 2021, printed Mar. 25, 2021 from https://www.youtube.com/watch?v=06WMvsUFTpY.
Stop-Painting.com, Youtube, Beveled Ring Guards: How They Work to Protect your Floor Signs, dated Dec. 4, 2020 printed Mar. 25, 2021 from https://www.youtube.com/watch?v=xK_QaPu9fNQ.

* cited by examiner

PERIMETER PROTECTIVE DEVICE FOR FLOOR SIGN

CROSS REFERENCE TO RELATED APPLICATIONS

This application claims the benefit of U.S. Provisional Patent Application No. 62/984,726 filed Mar. 3, 2020; the disclosures of which are incorporated herein by reference.

BACKGROUND OF THE DISCLOSURE

1. Technical Field

The disclosure generally relates to items that protect marking devices configured to be secured to a floor and, more particularly, to a perimeter protective device the limits damage of floor signs. More specifically, the disclosure relates to a multi-section ring-shaped protective device having both its inner and outer surfaces tapered down from an upper surface that is disposed higher than the upper surface of a floor sign.

2. Background Information

Different types of floor signs are located on floor surfaces in a wide variety of facilities. The floor signs typically are adhered to the floor. The floor signs are typically paper-based or polymer. Such signs are sized to be seen and read by people driving fork lifts and other vehicles. These signs can have a width of one to two feet in width or diameter. Floor signs are designed to be walked and driven over which leads to wear and tear on the edges and uppers surfaces of the signs. In some facilities, the dragging or sliding of crates, plastic tubs, totes, metal racking with and without casters, pallet jacks, corrugated bins, toolboxes, and pallet drags damage the signs to a degree where they have to be replaced.

When small adhesive labels are applied to a floor (for example in front of shelving or storage bins), single-piece frames have been placed over and around the labels with and without covering the label with a clear cover. These metal frames provide protection to the labels. Such labels are also protected by covering the entire label with a clear piece of adhesive-backed material that laminates the label to the floor.

SUMMARY OF THE DISCLOSURE

The disclosure provides a protective device that is installed about the outer edge or outer edges of a floor sign. The main body portion of the protective device is taller than the thickness of the sign such that a device will ride on the top of the protective device as it passes over the floor sign. The protective device includes a ramped or tapered outer edge that helps a device to slide up onto the top surface of the protective device and decrease the impact force of the device when it initially encounter the protective device. In the exemplary configuration, the inner edge of the protective device is also ramped or tapered down to at least the height of the floor sign. The protective device is made from a hard material that is impact resistant and provides a smooth lower friction upper surface. A semi-rigid or rigid PVC can be used. A polycarbonate can be used.

The protective device is installed around the outer perimeter of a vinyl or paper floor sign or label. The device allows pallets to travel up and over the sign/label. The sign/label is usually made from a less durable, easier to tear substrate material typically having with a straight 90 degree edge. The sign/label is usually more narrow than a pallet which allows the pallet to ride over the sign/label on the protective device instead of impacting the edge of the sign/label and then scraping the upper surface of the sign/label.

The disclosure provides a protective device that is applied about the perimeter of the floor sign in multiple sections. The ends of the sections are ramped or tapered in the same manner as the inner and outer edges such that the abutment of two sections of the protective device has a low height which is less than the thickness of the floor sign. This low abutment prevents the protective device from retaining liquid on top of the sign.

The disclosure provides a protective device that is adhered to the floor about the perimeter of the floor sign. In the exemplary configuration, no portion of the protective device overlaps the edge of the floor sign.

The individual features may be combined in different combinations than specifically described below to form different configurations of the device of the disclosure. The preceding non-limiting aspects of the disclosure, as well as others, are more particularly described below. A more complete understanding of the devices, assemblies, and methods can be obtained by reference to the accompanying drawings, which are not intended to indicate relative size and dimensions of the assemblies. In those drawings and the description below, like numeric designations refer to components of like function. Specific terms used in that description are intended to refer only to the particular structure of the embodiments selected for illustration in the drawings, and are not intended to define or limit the scope of the disclosure.

DETAILED DESCRIPTION OF EXEMPLARY EMBODIMENTS

Figure 1:
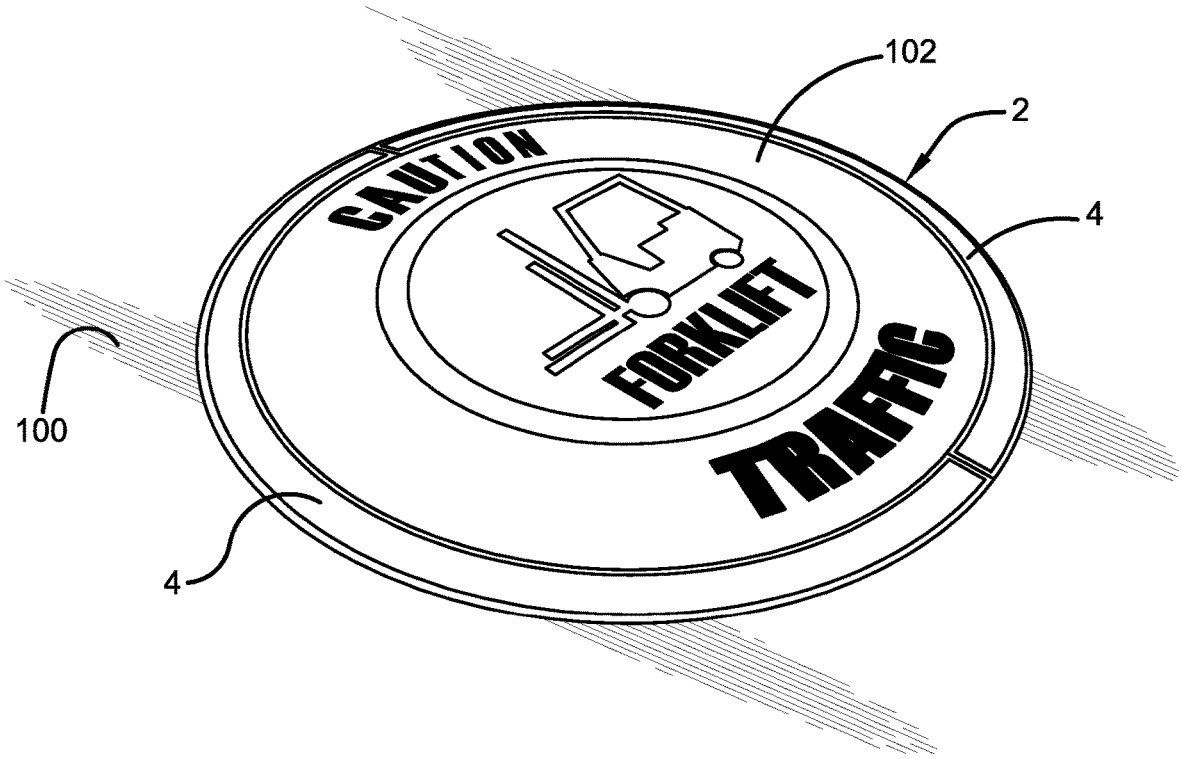
FIG. 1 depicts a floor sign with a two-section protective device disposed about the perimeter of the floor sign.
Figure 2:
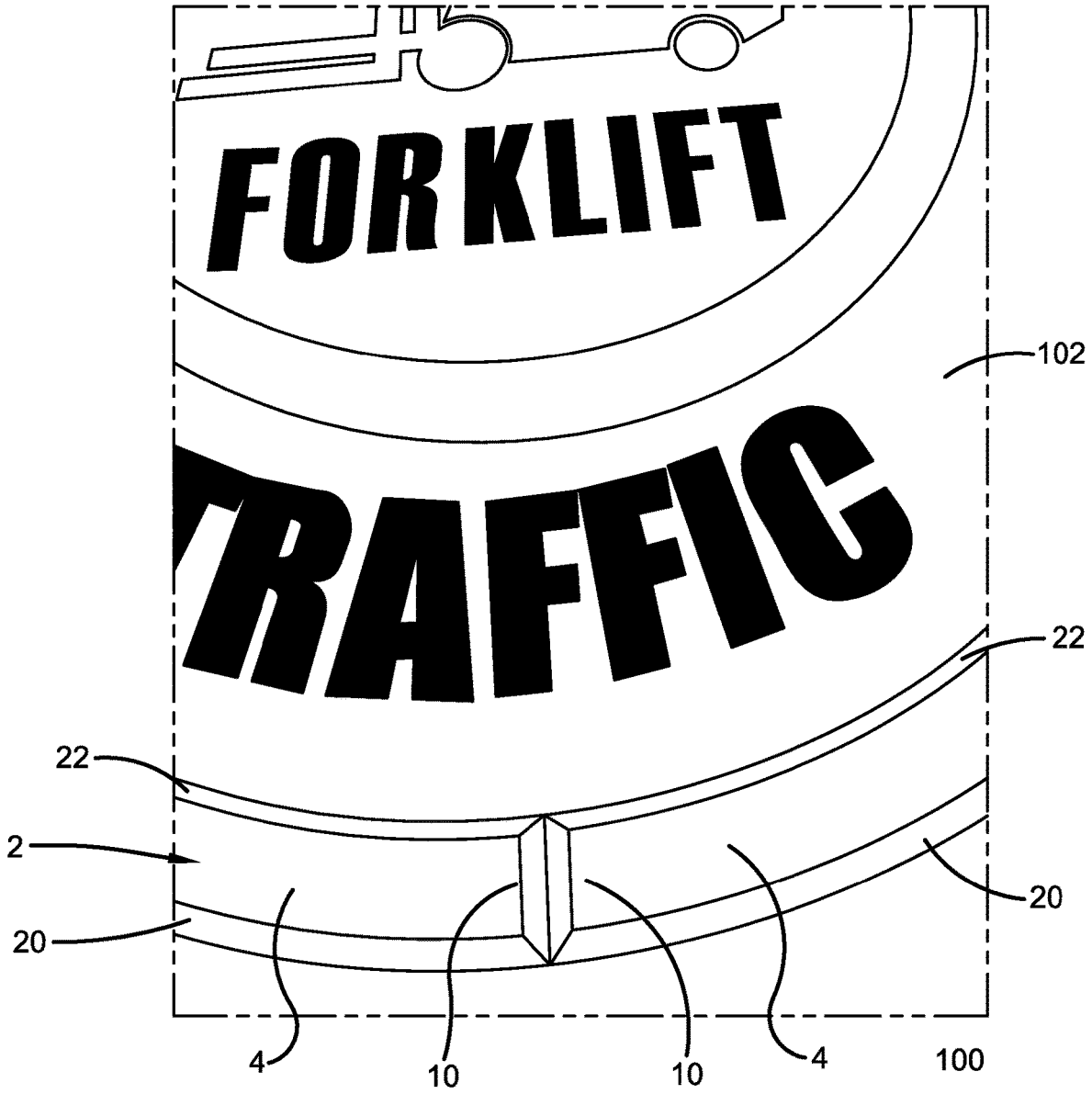
FIG. 2 is an enlarged view of two section ends of the perimeter protective device.

An exemplary configuration of a two-section protective device is indicated generally by the reference numeral 2 in the accompanying drawings. Protective device 2 is installed directly on a floor 100 around the outer perimeter of a floor sign 102 to protect floor sign 102 from wear and tear. In the exemplary configuration, no portion of protective device 2 overlaps floor sign 102 and no portion of protective device 2 is connected to floor sign 102. Protective device 2 is taller than floor sign 102 and thus causes items to ride on protective device 2 instead of sliding across floor sign 102. Protective device 2 thus absorbs a majority of the impact forces of an item sliding across floor 100 over sign 102 and can prevent some items from contacting sign 102.

Figure 3:
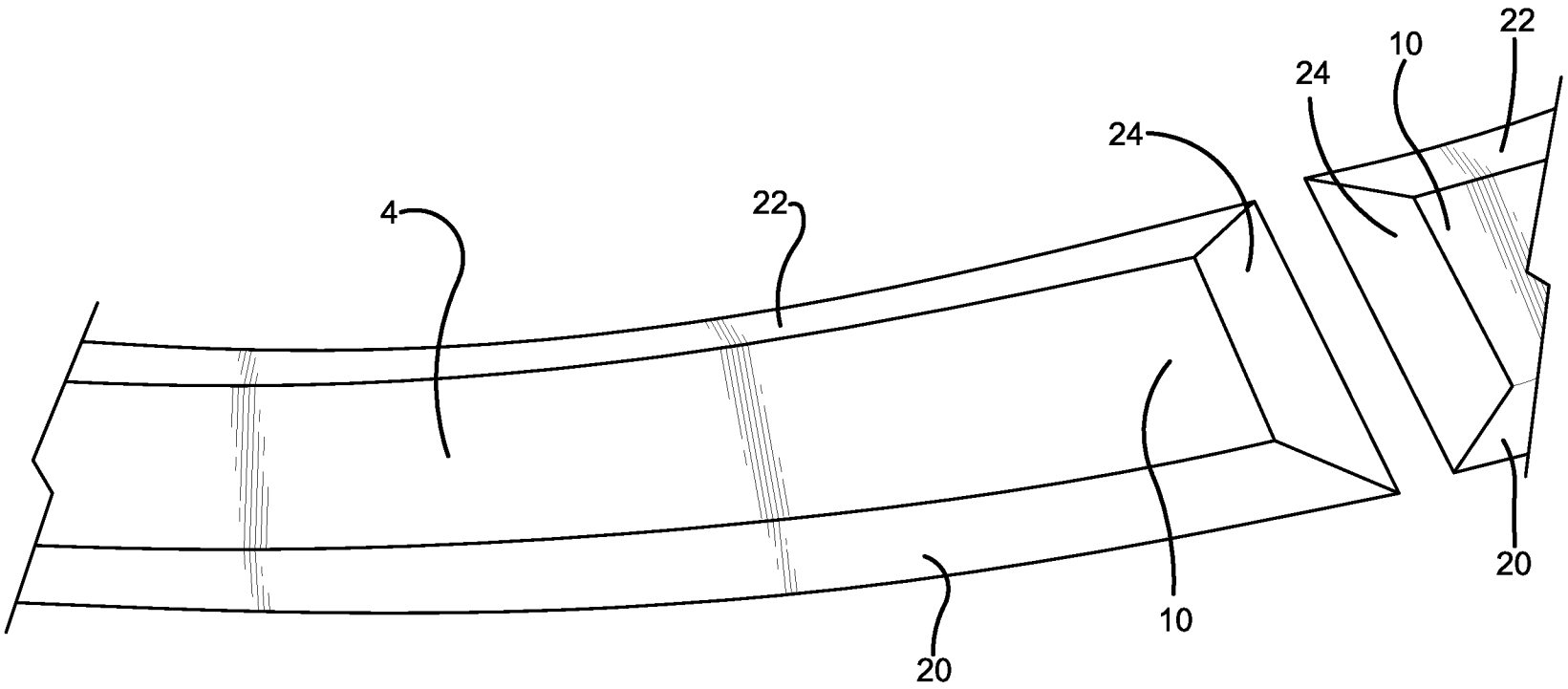
FIG. 3 is an enlarged view of exemplary protective device sections with the tapered edges closely spaced but not touching.
Figure 5:
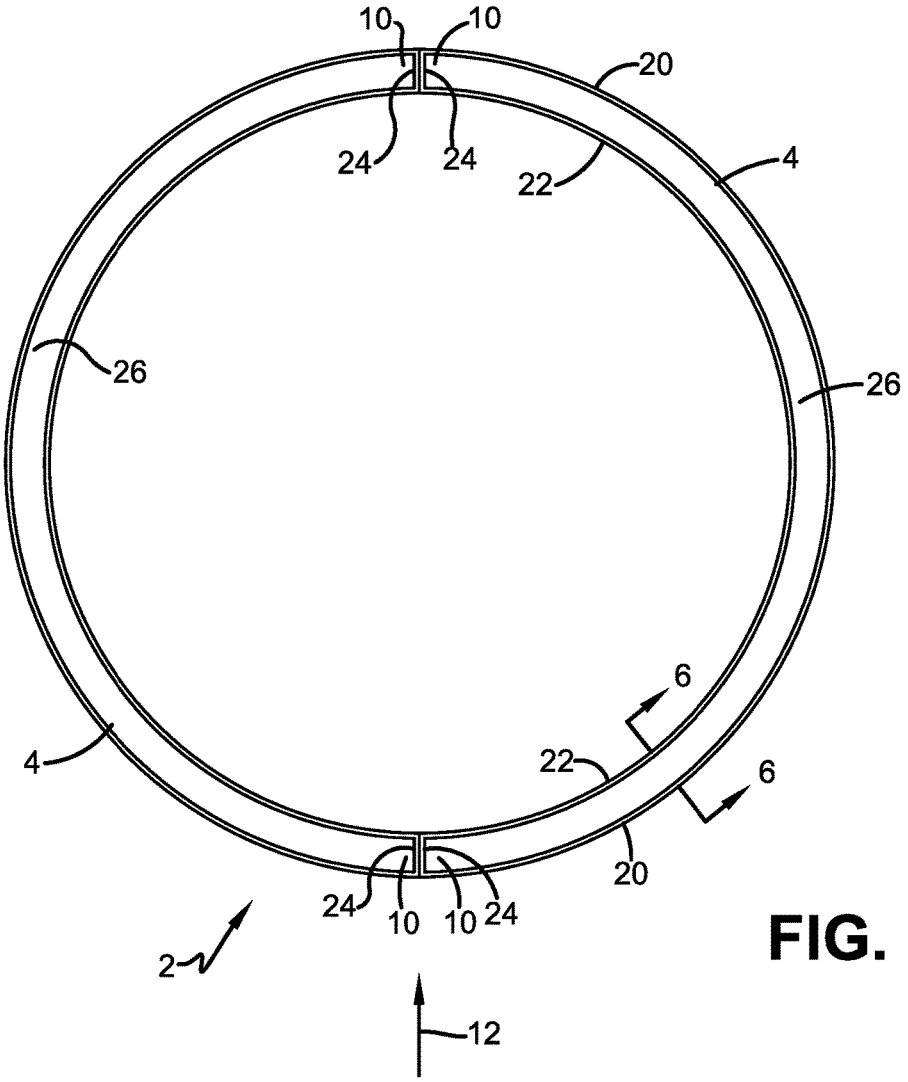
FIG. 5 is a top plan view of an exemplary two-section protective device.

Protective device 2 is made up of either a continuous single section with no ends, a single section with two abutting ends, or a plurality of sections 4 disposed about the outer perimeter of floor sign 102. When arranged with their ends aligned, sections 4 enclose an area which is where the sign is located. The inner edges of sections 4 can contact the outer edge of floor sign 102. In the exemplary configuration, each section 4 is a portion of a circle. Two semi-circular sections 4 for a circular sign 102 are depicted in the drawings but other numbers of sections can be used to make up the entire circle and each section can make up a different percentage of the circle. Other numbers of sections can be used such as four, six, or eight to match square, hexagonal, and octagonal sign shapes. When installed, the ends 10 of sections 4 are aligned to define an enclosed area that matches the shape of the sign 102 that is being protected by device 2. When installed, ends 10 are either closely spaced (spaced apart a distance less than the width of the tapered edge as shown in FIG. 3) or abutting (touching as shown in FIG. 5). Although more than two sections 4 can be used to form device 2, using two sections 4 for a circular sign provides only two locations where ends 10 are located and these are positioned parallel to the traffic direction 12 (FIG. 5) so that ends 10 do not act as catches for items being dragging over protective device 2 in traffic direction 12. The text and/or graphics of sign 102 are perpendicular to the traffic direction 12.

Figure 6:
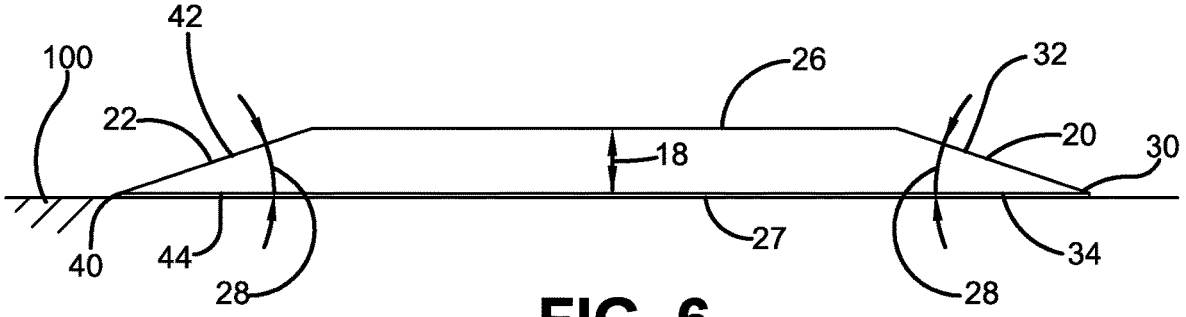
FIG. 6 is a section view of a protective device section taken along radius line 6-6 of FIG. 5.

Each section 4 has a body that has an upper surface 26 and a lower surface in contact with an adhesive 27 that connects section 4 to floor 100. The lower surface of section 4 can be generally flat and uninterrupted or can define a recess which receives adhesive 27. Upper surface 26 can be: flat between edges 20 and 22 (as shown in FIG. 6) so that it is parallel with the surface of floor 100 when device 2 is installed; angled such that surface 26 is non-parallel with the surface of floor 100 when device 2 is installed; or convex. In the exemplary configuration, lower surface is one inch wide tip to tip (between reference numbers 30 and 40 in FIG. 6). The flat upper surface 26 is 0.64 inches wide between tapered edges 20 and 22 as measured along a radius. The body has a thickness 18 between upper surface 26 and the lower surface of 0.062 inches which is slightly thicker than the maximum thickness of the substrate used to form floor sign 102. Thickness 18 or thickness 18 in combination with the thickness of adhesive 27 positions upper surfaces 26 of sections 4 above the upper surface of floor sign 102 so that items being dragged over device 2 and floor sign 102 will ride on sections 4 and not damage the upper surface of floor sign 102. In the exemplary configuration, device 2 only needs to be slightly thicker than sign 102. In other configurations, device 2 has a height that is at least twenty-five percent higher than the sign about which it is to be used. In another configuration, device is fifty-percent taller than sign 102. Another configuration of device 2 has thickness 18 at 0.030 inches with upper surface 26 being 0.852 inches wide between edges 20 and 22 as measured along a radius. The use of device 2 allows floor sign 102 to be thinner than an unprotected sign because the protected sign 102 takes less wear and tear and does not have to be made as tough.

When configured for a circular floor sign 102, protective device 2 has an inner diameter of 17.5 inches (with an outer diameter of 19.5 inches) as depicted in FIG. 5 or, in another embodiment, an inner diameter of 22.0 inches and an outer diameter of 24.0 inches. These are configured to fit around 17.5 and 22.0 inch diameter floor signs, respectively, with gaps (closely spaced as defined above) between the ends of sections 4.

Sections 4 can be made from a hard, impact-resistant polymer. The polymer may be substantially transparent or colored to match floor sign 102. Both the transparent and matching color options minimize the visibility of device 2. Sections 4 can be made from PVC or polycarbonate. The PVC can be a semi-rigid PVC with a Shore D hardness of 83 to 95 (ASTM D224). An example material is Vintec I®. The material is impact resistant. The polycarbonate can have a Rockwell hardness of 125 on the R scale and 70 on the M scale (ASTM D-785). An example polycarbonate is sold by Palram Americas Ltd. under the PALSUN® trademark.

An adhesive is used to connect the body to the floor surface. An example adhesive is a permanent pressure sensitive acrylic adhesive. An example is part number FLX012731-FLEXmount®—sold by FLEXcon Company, Inc. with is a 4 mil adhesive supported on a release liner. The release liner is removed from the adhesive before device 2 is installed. Another exemplary adhesive is AP9104 by Applied Products which is a 4 mil acrylic adhesive.

Each section 4 has a tapered outer edge 20, a tapered inner edge 22, and first and second tapered edges 24 at ends 10. Edges 20, 22, and 24 are tapered down from the upper surface 26 of section 4. The term 'tapered' means that the structures become thinner in one direction. The edges can become thinner at a constant rate or at a varying rate. The upper surface of a tapered edge can be straight as shown in the exemplary configurations or it can be curved. It can join with upper surface 26 at a distinct edge as shown in the drawings or be smoothly joined such as a curve that joins upper surface 26 tangentially and is thus a continuation of the surface. The upwardly-facing surface of each edge 20, 22, and 24 thus can be flat or curved. Each edge 20, 22, and 24 can be configured with the same geometry. In one example, the upper surface of the tapered portion forms an internal acute angle 28 which can be fifteen to thirty degrees with a flat floor surface. The exemplary configuration has angle 28 at nineteen degrees. In another exemplary configuration, angle 28 is twenty to twenty-four degrees and can be twenty-two degrees. Edge 20 is tapered to a low point or junction 30 close to the floor. Junction 30 is where the upper surface 32 of the tapered edge 20 meets the lower surface 34 of the tapered edge 20. Although it is desired to have junction 30 as pointed, thin, and close to the floor surface as possible, manufacturing and material limitations give junction 30 a cross sectional shape such as a rounded or squared-off shape. Junction 30 thus has a height where upper surface 32 departs junction 30. Edge 22 is also tapered to a point or junction 40 close to the floor. Junction 40 is where the upper surface 42 of the tapered edge 22 meets the lower surface 44 of the tapered edge 22. Although it is desired to have junction 40 as pointed, thin, and close to the floor as possible, manufacturing and material limitations give junction 40 a cross sectional shape such as a rounded or squared-off shape. Junction 40 thus has a height where upper surface 42 departs junction 40. The height of junction 40 only needs to be less than the thickness of the outer edge of sign 102 and can thus be larger than the height of junction 30.

Ends 10 have tapered edges 24 that taper to a point close to the floor or to a junction height below the thickness of floor sign 102. The end shapes complement each other so that the shape of a first end of one section matches the shape of a second end of a second section. In the exemplary configuration, the end shapes are straight and are defined along a radius. Having ends 10 spaced apart or abutting but lower than the height of floor sign 102 defines liquid run-off channels that allow liquid disposed on floor sign to drain from the floor sign through the protective device 2.

Figure 4:
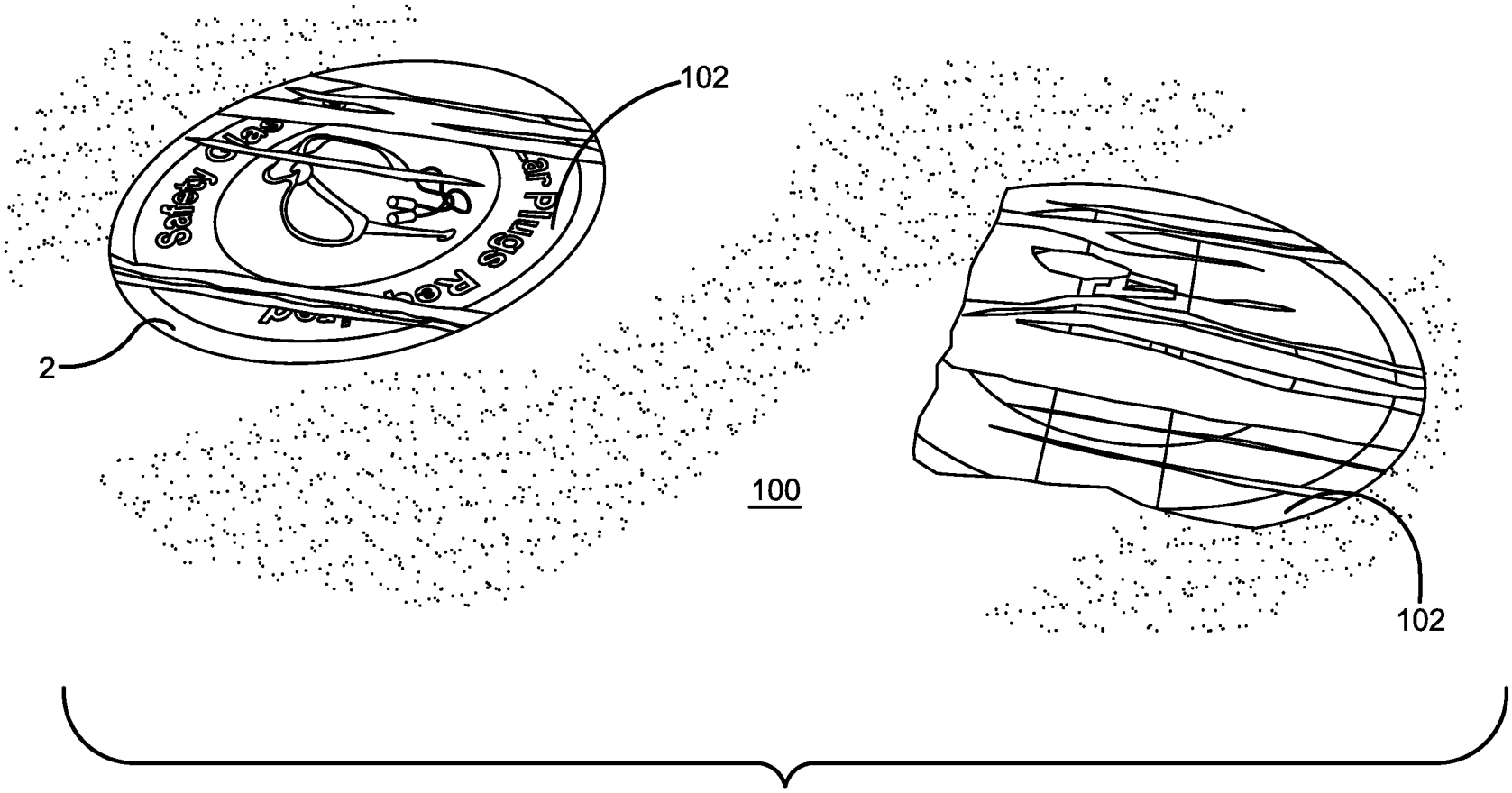
FIG. 4 shows a comparison of a floor sign with an exemplary protective ring on the left compared to a floor sign on the right without the protective device.

FIG. 4 depicts the exemplary configuration of FIG. 5 used with a floor sign disposed on the left side of the image with an unprotected floor sign shown on the right side. The picture shows the result of 50 passes of a pallet with nails dragged over each floor sign. FIG. 4 shows the floor sign with protective device 2 has much less wear in this abusive test. Although the nails have scratched lines in the floor sign on the left, the floor sign is generally intact and has not been peeled up from its edge. The original photograph of this comparison was included with the provisional application from which this application claims the benefit.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the above description and attached illustrations are an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A protective device that can be installed around the outer perimeter of a floor sign to protect the floor sign from wear; the device comprising:

first and second independent sections;

each of the first and second sections having first and second ends;

each of the first and second sections having a tapered inner edge and a tapered outer edge;

each of the first and second sections having an upper surface defined between the inner and outer tapered edges; and the first and second ends of each section being spaced apart the same distance such that the first end of the first section can be aligned with the second end of the second section at the same time the second end of the first section is aligned with the first end of the second section wherein the first and second sections cooperate to enclose an area between the first and second sections.

2. The device of claim 1, wherein the first and second sections define portions of a circle and have the same radius such that the first and second sections form a circle when arranged with the first end of the first section aligned with the second end of the second section and the second end of the first section is aligned with the first end of the second section.

3. The device of claim 2, wherein the shape of the first end of the first section complements the shape of the second end of the second section.

4. The device of claim 1, wherein the first and second ends of each of the first and second sections are tapered in a direction from the upper surface to toward a lower surface of the section.

5. An assembly comprising:

a floor sign connected to a floor; the floor sign having a maximum height above the floor;

a protective device disposed around the floor sign; the protective device including a plurality of independent sections having ends which are aligned;

each of the sections connected to the floor with an adhesive;

each of the sections having a height above the floor that is greater than the maximum height of the floor sign; and wherein each of the sections has an upper surface and a lower surface;

the ends of the sections are tapered in a direction from the upper surface toward the lower surface.

6. The assembly of claim 5, wherein each of the sections has an outer tapered edge and an inner tapered edge.

7. The assembly of claim 6, wherein an upper surface of the outer tapered edge defines an acute angle with the floor.

8. The assembly of claim 5, wherein no portion of the protective device is disposed on top of any portion of the floor sign.

9. An assembly comprising:

a floor sign connected to a floor; the floor sign having a maximum height above the floor;

a protective device disposed around the floor sign; the protective device including a plurality of independent sections having ends which are aligned;

each of the sections connected to the floor with an adhesive;

each of the sections having a height above the floor that is greater than the maximum height of the floor sign; and wherein no portion of the protective device is directly connected to any portion of the floor sign.

10. The assembly of claim 9, wherein each of the sections has an outer tapered edge.

11. The assembly of claim 10, wherein the ends of the sections are tapered in a direction from an upper surface of the section toward a lower surface of the section.

12. An assembly comprising:

a circular floor sign connected to a floor at an area having a primary traffic direction; the circular floor sign having a maximum height above the floor;

a protective device disposed around the circular floor sign; the protective device including first and second sections;

each of the first and second sections having a first end and a second end;

the first end of the first section being aligned with the second end of the second section and the second end of the first section being aligned with the first end of the second section to define a ring;

each of the first and second sections having a tapered outer edge and a tapered inner edge;

each of the sections being connected to the floor with an adhesive;

each of the sections having an upper surface that has a height above the floor that is greater than the maximum height of the floor sign; and wherein each of the sections has an upper surface and a lower surface;

the first and second ends of each section are tapered in a direction from the upper surface toward the lower surface.

13. The assembly of claim 12, wherein the first end of the first section abuts the second end of the second section.

14. The assembly of claim 12, wherein the first end of the first section is spaced from the second end of the second section to define a liquid run-off channel.

15. The assembly of claim 12, wherein the ends of the sections are parallel to the primary traffic direction.

16. The assembly of claim 12, wherein an upper surface of the outer tapered edge defines an acute angle with the floor.

17. The assembly of claim 12, wherein the sections are polyvinylchloride.

18. The assembly of claim 12, wherein the sections are polycarbonate.

19. An assembly comprising:

a circular floor sign connected to a floor at an area having a primary traffic direction; the circular floor sign having a maximum height above the floor;

a protective device disposed around the circular floor sign; the protective device including first and second sections;

each of the first and second sections having a first end and a second end;

the first end of the first section being aligned with the second end of the second section and the second end of the first section being aligned with the first end of the second section to define a ring;

each of the first and second sections having a tapered outer edge and a tapered inner edge;

each of the sections being connected to the floor with an adhesive;

each of the sections having an upper surface that has a height above the floor that is greater than the maximum height of the floor sign; and wherein the floor sign has an outer perimeter edge that has a height above the floor; the ends of the sections having portions disposed lower than the outer perimeter of the floor sign to define liquid run-off channels.

20. The assembly of claim 19, wherein no portion of the protective device is disposed on top of any portion of the floor sign.

21. An assembly comprising:

a circular floor sign connected to a floor at an area having a primary traffic direction; the circular floor sign having a maximum height above the floor;

a protective device disposed around the circular floor sign; the protective device including first and second sections;

each of the first and second sections having a first end and a second end;

the first end of the first section being aligned with the second end of the second section and the second end of the first section being aligned with the first end of the second section to define a ring;

each of the first and second sections having a tapered outer edge and a tapered inner edge;

each of the sections being connected to the floor with an adhesive;

each of the sections having an upper surface that has a height above the floor that is greater than the maximum height of the floor sign; and wherein no portion of the protective device is directly connected to any portion of the floor sign.

* * * * *